United States Patent [19]

Hougendobler

[11] Patent Number: 4,828,133

[45] Date of Patent: May 9, 1989

[54] DISPLAY CARTON WITH ADJUSTABLE DIVIDER

[75] Inventor: John Hougendobler, Greeneville, Tenn.

[73] Assignee: American Greetings Corporation, Cleveland, Ohio

[21] Appl. No.: 669,099

[22] Filed: Nov. 7, 1984

[51] Int. Cl.[4] ..... B65D 1/34

[52] U.S. Cl. ..... 220/22.3; 220/22; 206/44 R

[58] Field of Search ..... 229/15, 16 D, 27; 206/44 R, 45.14, 45.31; 220/21, 22, 22.3

[56] References Cited

U.S. PATENT DOCUMENTS

| | | | |
|---|---|---|---|
| 1,017,812 | 2/1912 | Schmelzer . | |
| 1,677,544 | 7/1928 | Brainard et al. . | |
| 1,757,141 | 5/1930 | Raster . | |
| 1,799,656 | 4/1931 | Tinsley | 229/27 |
| 2,082,667 | 6/1937 | Vanerveld | 45/7 |
| 2,178,091 | 10/1939 | Weiss | 229/27 |
| 2,300,411 | 11/1942 | Dubey | 220/27 |
| 2,312,594 | 3/1943 | Smith et al. | 229/15 |
| 2,368,349 | 1/1945 | Cornish | 129/16 |
| 2,678,045 | 5/1954 | Erhard | 129/16 |
| 2,701,089 | 2/1955 | Fischer | 229/16 D |
| 2,889,055 | 6/1959 | Weller et al. | 211/184 |
| 3,208,659 | 9/1965 | Blasdell et al. | 229/27 |
| 3,450,296 | 6/1969 | Schreyer | 220/22.1 |
| 3,544,182 | 12/1970 | Tainter | 312/237 |
| 3,675,763 | 7/1972 | Sandel | 229/27 |
| 3,680,177 | 8/1972 | Ginsberg | 24/73 PC |
| 3,680,687 | 8/1972 | D'Alessio | 229/27 |
| 3,687,278 | 8/1972 | Graham et al. | 206/44 R |
| 3,749,299 | 7/1973 | Ingle | 229/15 |
| 3,905,484 | 9/1975 | Dean et al. | 211/184 |
| 3,924,734 | 12/1975 | Gardner et al. | 206/44 R |
| 3,999,662 | 12/1976 | Barnhardt | 206/44 R |
| 4,058,206 | 11/1977 | Morse et al. | 229/15 |
| 4,207,978 | 6/1980 | Patterson et al. | 229/27 |
| 4,213,559 | 7/1980 | Meyers | 229/15 |
| 4,389,133 | 6/1983 | Oberst | 220/22.3 |
| 4,396,115 | 8/1983 | Watson | 206/44 R |
| 4,436,215 | 3/1984 | Kleinert et al. | 220/22.3 |
| 4,484,685 | 11/1984 | Williams | 209/703 |

*Primary Examiner*—David T. Fidei

*Attorney, Agent, or Firm*—Calfee, Halter & Griswold

[57] ABSTRACT

A disposable point-of-sale display carton constructed from corrugated paperboard is characterized by easy and adjustable installation of one or more corrugated paperboard divider panels within the carton which serve to separate and support merchandise in an orderly and attractive arrangement. Front and back walls of the carton each include adjacent inner and outer panels, and the inner panels each include therein through slots strategically located and paired with slots in the other inner panel across the depth of the carton. Female connectors selectively and removably received in through slots of any selected pair thereof each have a flange portion trapped between the inner and outer panels and a receiving portion extending inwardly through the slot. The receiving portion is slotted for receipt of a male connector on the divider panel or direct receipt of a vertical edge portion of the divider panel extending between the front and back walls.

14 Claims, 3 Drawing Sheets

DISPLAY CARTON WITH ADJUSTABLE DIVIDER

DISCLOSURE

The invention herein disclosed relates generally to the construction of disposable point-of-sale display cartons from corrugated paperboard and, more particularly, to the provision of one or more adjustable divider panels in such cartons which divider panels may serve to separate and maintain upright merchandise contained in the cartons. The cartons may be of considerable width and depth and are particularly intended to contain and display upright merchandise having a height greater than that of the carton such as single rolls of decorative gift wrapping paper or packages of such rolls.

BACKGROUND

Point-of-sale display cartons often are constructed from corrugated paperboard. Corrugated paperboard is fairly sturdy, being comprised of an adherent liner on one or both sides of a corrugated sheet of paperboard. Because it has substantial strength and load-bearing ability on the one hand and is inexpensive on the other hand, corrugated paperboard has proven to be a preferred material in disposable display cartons which are intended to be used for a short period and then discarded. For example, a display carton may be used for point-of-sale display of rolls of Christmas gift wrapping paper. After the Christmas season, there usually is no longer any use for the display carton. Rather than saving the display carton for the next Christman season, it may instead be simply discarded because of its construction from relatively low cost and easily disposable corrugated paperboard.

In order to maintain an orderly appearance of the merchandise contained in the display cartons, particularly as individual articles are removed from the display cartons from time to time, dividers or separators have been provided to maintain the articles of merchandise in rows, defined compartments, etc. In U.S. Pat. No. 4,213,559, a display carton constructed from paperboard stock material is divided into two display compartments by a partition panel. The partition panel is an integral part of a carton blank from which the divided display carton is constructed. As a result of the carton's construction, the partition panel is fixed in one position. Consequently, the partition panel cannot be adjusted along the width of the display carton to accommodate, for example, different sizes and/or numbers of articles in respective compartments defined by the partition panel.

In U.S. Pat. No. 2,178,091, a dual purpose container, i.e., a shipping display and dispensing container, is shown. The container is constructed from paperboard and is intended to contain a plurality of like packages of goods which are superimposed in rows one upon another for both purposes of shipping and counter display. The rows at each level are divided by a vertically positioned cardboard separator which serves to keep the packages in each row from becoming displaced. The separator, however, does not provide independent support for the packages but rather is supported by the stacked packages. Thus, as the packages are removed, the separator may become dislodged resulting in disorder of the packages remaining in the container.

U.S. Pat. No. 4,389,133 also relates to the art of display carton construction from corrugated paperboard.

This patent discloses an assembly for intercoupling pieces of corrugated material at right angles with respect to each other. Such assembly comprises a female connector and a male connector having respective female and male portions adapted to mate and interlock with each other. Each connector also includes another portion having a thickness dimension suitable for insertion between the liners of the respective corrugated panel in place of the corrugated material of such panel.

SUMMARY OF THE INVENTION

The invention herein disclosed provides a point-of-sale display carton constructed from corrugated paperboard which is characterized by easy and adjustable securement of one or more corrugated paperboard divider panels within the carton which may serve to separate and support merchandise in an orderly and attractive arrangement. The display carton is of open top and disposable/temporary type, and has particular application in the display of articles of greater height than that of the carton in upright disposition maintained by the divider panel or panels and the outer walls of the carton. The display carton may be of considerable size, e.g., at least 15 inches high and at least 2 feet long.

According to the invention, a display carton comprises a corrugated paperboard box including a bottom wall, a pair of side walls and front and back walls. At least the front and back walls include adjacent outer and inner corrugated paperboard panels. The inner panels of the front and back walls each include therein spaced-apart through slots strategically located along the width of the box and paired with respective through slots in the other inner panel across the depth of the box. The display carton further comprises at least one female connector selectively and removably receivable in any one of the through slots in the inner panel of the front wall and at least one other female connector selectively and removably receivable in any one of the slots in the inner panel of the back wall. Each female connector includes a thin planar flange portion and a receiving portion extending substantially perpendicularly from the flange portion a distance greater than the thickness of the respective inner panel of the front and back walls. The receiving portion defines therein a receiving slot and is transversely dimensioned for passage through and locating engagement in any one of the through slots in the respective inner panel with the receiving slot located inwardly of the inner panel. The flange portion extends laterally beyond the receiving portion for trapped engagement between the inner and outer panels adjacent the selected through slot through which the receiving portion extends. The display carton also includes a divider wall including a corrugated paperboard divider panel extendable between the front and back walls and a male connector or means at each vertical edge of the divider panel receivable in the receiving slots of respective female connectors received in respective through slots of a selected pair thereof for holding the divider panel upright and in selected position.

With this construction, the divider panel may be held upright between the front and rear walls of the box at any one of a number of selectable positions corresponding to a paired set of through slots respectively in the inner panels of the front and rear walls. Once a desired position for the divider panel has been determined, female connectors are inserted into the corresponding through slots and the flange portions thereof trapped between the respective inner and outer panels of the front and rear walls. The divider panel then may be slipped into place and engaged at its vertical edges with the female connectors. Another divider panel may be mounted in the display carton in similar manner at another desired location with another set of female connectors. Also, each divider panel may be readjusted as needed by removing the female connectors from their initial through slots and relocating them in respective through slots of another pair corresponding to the desired new position of the divider panel.

In the preferred application of the invention, male and female connectors of the type disclosed in the aforementioned U.S. Pat. No. 4,389,133 are utilized to positively lock the divider panel to the front and back walls of the carton box, but with each female connector being releasably connected to the front and back walls at any one of a plurality of adjustment locations for a divider panel.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
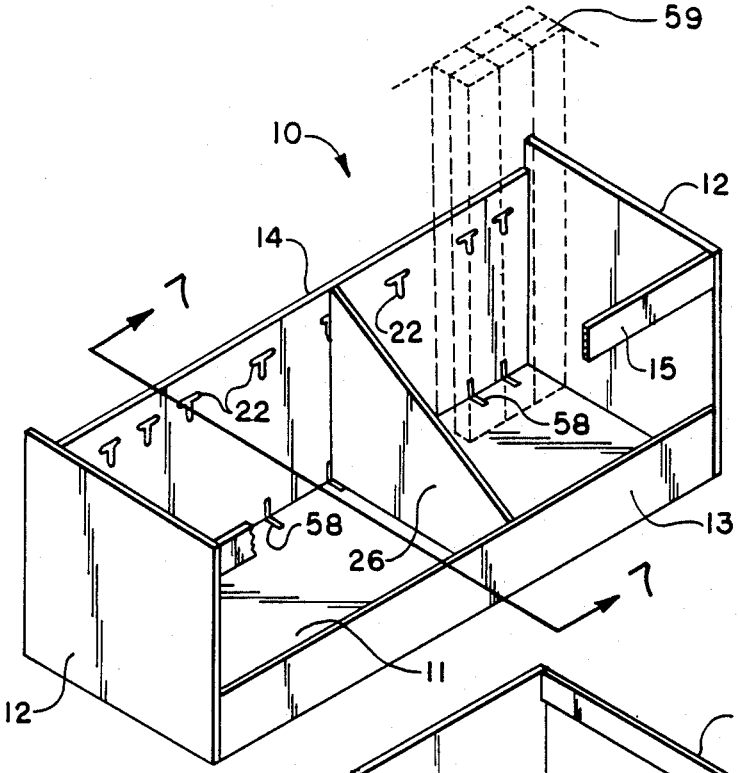
FIG. 1 is a front perspective view, partly broken away, of a display carton according to the invention.
Figure 2:
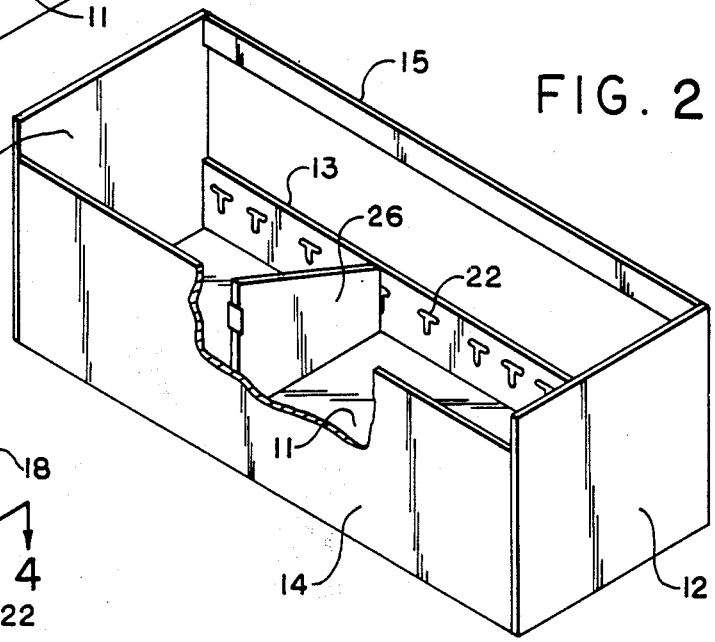
FIG. 2 is a rear perspective view, partly broken away, of the display carton of FIG. 1.

Referring now in detail to the drawings and initially to FIGS. 1 and 2, a display carton with an adjustable divider according to the invention is designated generally by reference numeral 10. The display carton 10 comprises a bottom wall 11, side walls 12, a front wall 13 and a back wall 14, all of which are formed from corrugated paperboard panels. Together, the walls 11–14 form a box having an open top and partly open front in view of the lower height of the front wall 13 in relation to the side walls 12 and back wall 14. As shown, the back wall 14 is slightly lower in height than the side walls 12 and all of the walls are rectangular in shape. A horizontal beam 15 constructed from folded corrugated paperboard extends between the upper front corners of the side walls parallel to the top edge of the front wall. The top edge of the front wall is spaced a considerable distance below the horizontal beam to provide a front window for greater product visibility. The particular manner in which the outer walls of the carton are connected, attached or otherwise joined does not constitute a part of this invention but rather is well within the realm of one skilled in the art of constructing display cartons from corrugated paperboard.

The walls 11–14 all may be of double panel construction but at least the front wall 13 and back wall 14 are of double panel construction each having adjacent inner and outer corrugated paperboard panels 18 and 19. This can be seen in FIG. 3 which is a representative view of an upper inside area of either the front wall or back wall. As may be desired, the inner and outer panels 18 and 19 may be formed from a single piece of corrugated paperboard which is folded upon itself to form the double panel construction with the inner and outer panels being joined together along the fold located preferably along the top edge of the thusly constructed wall. As shown, the corrugated paperboard is of conventional type including an adherent liner 20 on both sides of a corrugated sheet 21 of paperboard, the latter being schematically illustrated by a wavy line.

Figure 3:
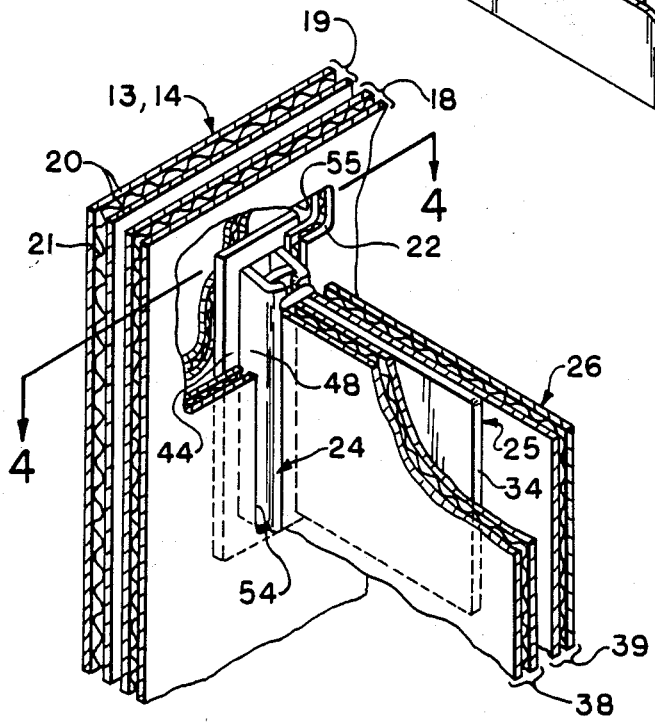
FIG. 3 is an enlarged fragmentary perspective view representative of an upper inside area of either the front or back wall of the display carton.

As shown in FIGS. 1 and 2 and with greater detail in FIG. 3, the inner panels 18 of the front and back walls 13 and 14 are each provided with a plurality of identical through slots 22. The through slots 22 open inwardly to the interior of the carton 10 but are closed outwardly by the adjacent outer panel 19. The through slots in each inner panel of the front and back walls are transversely aligned with corresponding through slots in the other panel to form paired sets of slots across the depth of the box. The paired slots are strategically located along the width of the carton, and each through slot is dimensioned for locating and holding receipt of a female connector 24 in the manner hereinafter described.

The female connector 24 is adapted to interlock with a male connector 25 affixed to a divider wall 26 at a vertical edge thereof. The male and female connectors preferably are of the type disclosed in the above mentioned U.S. Pat. No. 4,389,133 which is hereby incorporated herein by reference for completeness of description of the female and male connectors.

Figure 4:
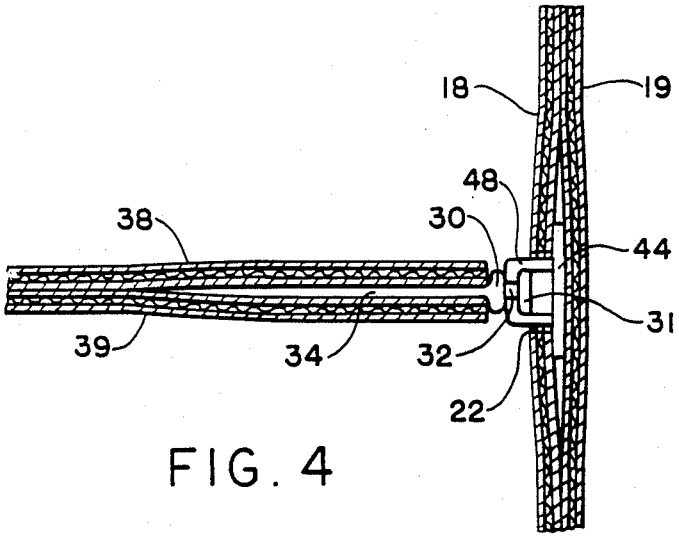
FIG. 4 is a section taken substantially along the line 4—4 of FIG. 3.
Figure 5:
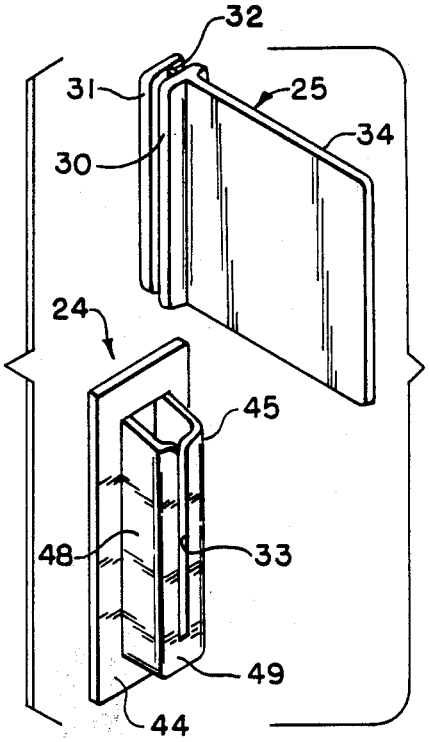
FIG. 5 is a perspective view of male and female connectors utilized in the display carton.

As seen in FIGS. 3–5, the male connector 25 has parallel inner and outer flanges 30 and 31 which are spaced from each other and connected by a rib portion 32 to form a coupling portion of such connector. The rib portion 32 has a thickness substantially smaller than the width of the flanges 30 and 31 and is sized to fit within a receiving slot 33 of the female connector 24. The male connector 25 further has a leaf portion 34 affixed to the inner flange 30 which extends substantially perpendicular to such inner flange. The leaf portion 34 is generally planar and provides for attachment of the male connector to the divider wall 26 at a vertical edge thereof.

More particularly, the divider wall 26 may be of a double panel construction including a pair of adjacent corrugated paperboard panels 38 and 39. Such panels 38 and 39 may be formed from a single sheet of corrugated paperboard folded upon itself to form the panels and to provide the divider wall with a smooth folded top edge. The leaf portion 34 of the male connector 25 may be trapped and secured by suitable means such as an adhesive between the two divider panels at the vertical edge of the divider wall. It also is noted that the leaf portion alternatively may be fitted between the liners of either panel or a single wall forming panel as in the manner described and illustrated in the above mentioned U.S. Pat. No. 4,389,133.

A male connector 25 is attached to the divider wall 26 at each vertical edge thereof at a height corresponding to the height of the through slots 22 in the adjacent inner panel 18 of the front and back walls 13 and 14. Also, the top straight edge of the divider wall can be seen to angle downwardly from the top edge of the back wall to the top edge of the front wall.

The female connector 24 includes a planar back or flange portion 44 which is generally rectangular. A generally U-shape receiving portion 45 of the female connector extends outwardly from the flange portion 44 and defines the receiving slot 33 therein, which receiving slot is open at its top end and closed at its bottom end. The receiving slot 33 is sized to receive the rib portion 32 of the male connector 25.

The receiving portion 45 includes a generally U-shape side wall 48 which extends substantially perpendicularly from the flange portion 44 a distance greater than the thickness of the inner panels 18 of the front and back walls 13 and 14 as best seen in FIG. 4. The receiving portion 45 also has a front wall 49 which includes the receiving slot 33. Together the side wall 48 and front wall 49 define a receiving volume of the appropriate dimension so that the outer flange 31 of the male connector can comfortably fit in this volume when the rib portion 32 is received within the slot 33. For further details of the particular construction of the male and female conductors, reference may be had to the above mentioned U.S. Pat. No. 4,389,133.

The female connector 24 can be inserted into any selected one of the through slots 22 in the inner panels 18 of the front and back walls 13 and 14. Each through slot 22 has a T-shape with the stem portion 54 of the slot extending vertically. Such stem portion has a width and length respectively corresponding to the width and length of the receiving portion 45 of the female connector for locating receipt of such receiving portion. On the other hand, the head portion 55 of the through slot has a width greater than the width of the flange portion 44 of the female connector, which flange portion extends laterally beyond the receiving portion at both sides thereof as well as above and below the receiving portion.

The head portion 55 of each through slot 22 permits downward insertion of the flange portion 44 of the female connector 24 between the inner and outer panels 18 and 19 of the respective front or back wall 13, 14 as the receiving portion 45 of the female connector is downwardly slipped into the stem portion 54 of the through slot. Once fully inserted, the female connector will be laterally and vertically located by engagement between the receiving portion and the sides of the stem portion of the through slot. The female connector also will be locked against pull-out or push-out at right angles to the planes of the inner and outer panels because of trapped engagement of the flange portion 44 between the inner and outer panels outwardly adjacent the through slot.

To install the divider wall 26 within the display carton, there is first selected a desired position of the divider wall corresponding to a set of paired through slots 22 in the inner panels 18 of the front and back walls 13 and 14. A female connector 24 then is inserted into each through slot at such desired position of the divider wall. The divider wall having a width corresponding to the interior depth of the display carton then is lowered into the carton with the male connectors 25 at respective front and rear vertical edges thereof being inserted into interlocking engagement with the female connectors connected as indicated to the front and back walls, respectively. When properly mated, the male and female connectors will hold the divider wall upright at the desired location. The lower rear corner of the divider wall may also be engaged in a corner slot 58 provided in the back and bottom walls 14 and 11 at their juncture which resides in the vertical plane of the through slots into which the female connectors are inserted. As seen in FIG. 1, a corner slot 58 may be provided for each set of paired through slots 22.

In similar manner, additional divider walls may be installed within the display carton and held upright in position by male connectors at its vertical edges engaged with respective female connectors inserted into through slots corresponding to selected positions of such divider walls. Also, a previously installed divider wall may be repositioned by relocating the respective female connectors in a different set of paired through slots, as desired. Accordingly, compartments of desired width may be provided for orderly arrangement of merchandise in the display carton.

As indicated, the display carton has particular application in the display of articles of greater height than that of the carton in upright disposition maintained by the divider panel or panels and the outer walls of the carton. As illustrated in FIG. 1, the top ends of articles such as packaged rolls of gift wrapping paper shown in broken lines at 59 project above the top of the carton for attractive display when their bottom ends are supported atop the bottom wall of the display carton. As is preferred, the bottom wall may have a slight front-to-rear slope to cause a depth-wise stack of articles to lean against the back wall to facilitate maintenance of an orderly appearance as individual articles are removed from the front of the stack. Moreover, the display carton preferably has a height of at least 15 inches and a length of at least 3 feet with a length of about 4 feet being most preferred for modular usage of plural display cartons in end-to-end disposition. In preferred usage, the display carton may be supported on the floor or on a low level shelf or stand such as a foot shelf or a display gondola forward of a vertical peg board from which related articles such as ribbon, bows, etc. may be hung.

Figure 6:
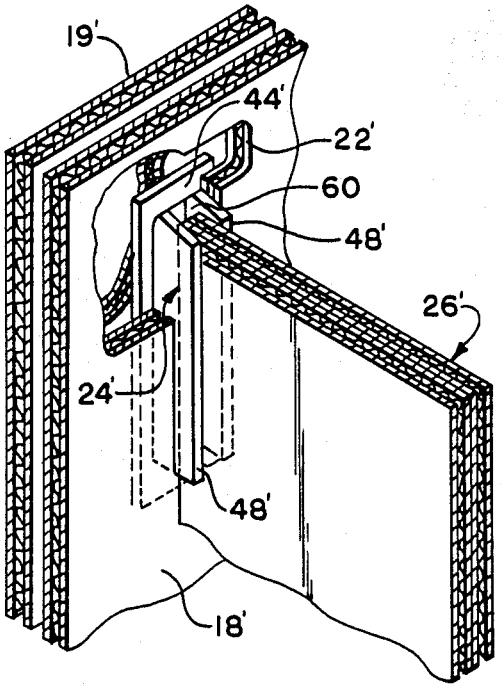
FIG. 6 is a fragmentary perspective view similar to FIG. 3 but of a modified embodiment of the invention.
Figure 7:
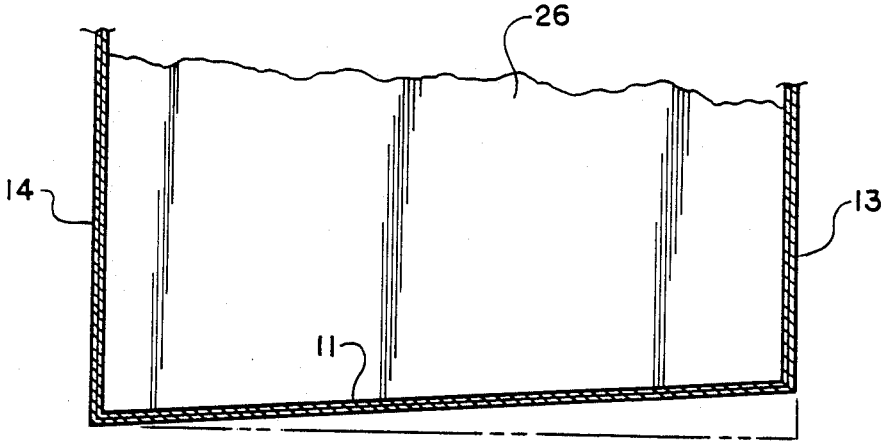
FIG. 7 is a cross-sectional view of the display carton of FIG. 7 taken along line 7—7 thereof showing the sloping bottom wall.

In FIG. 6, wherein primed reference numerals designate elements corresponding generally to those identified above by the same unprimed reference numerals, a modified female connector 24' has parallel side walls 48' which extend at right angles from the flange portion 44' and define therebetween a receiving slot or channel 60 that is open both top and bottom. The width of the channel 60 is about equal to or slightly less than the thickness of the divider wall 26' for receipt of a vertical marginal edge portion of such divider wall as shown.

The female connector 24' eliminates the need for a male connector at the vertical edge of the divider wall 26'. Rather, the vertical marginal edge portion of the divider wall is directly received and laterally held in the receiving channel 60. Installation of the divider wall otherwise is essentially the same as aforedescribed. Female connectors 24' are inserted into selected through slots 22' and then the divider wall is lowered edgewise into the display carton with the vertical edges thereof slipped downwardly into the vertically oriented channels 60 of the female connectors.

Although the invention has been shown and described with respect to several embodiments, it is obvious that equivalent alterations and modifications will occur to others skilled in the art upon the reading and understanding of this specification. The present invention includes all such equivalent alterations and modifications, and is limited only by the scope of the following claims.

I claim:

1. An open-top display carton with adjustable divider for display of merchandise in upright disposition, comprising:

a corrugated cardboard box including a bottom wall, a pair of side walls and front and back walls, at least said front and back walls including adjacent outer and inner corrugated cardboard panels, and said inner panels of said front and back walls each including therein spaced-apart through slots strategically located along the width of the box and paired with respective through slots in the other inner panel across the depth of the box;

at least one female connector selectively and removably receivable in any one of said slots in the inner panel of said front wall and at least one other female connector selectively and removably receivable in any one of said slots in the inner panel of said back wall, each female connector including a thin planar flange portion and a receiving portion extending substantially perpendicularly from said flange portion a distance greater than the thickness of the respective inner panel of said front and back walls, said receiving portion defining therein an open-end slot and being transversely dimensioned for passage through and locating engagement in any one of the through slots in the respective inner panel with the open-end slot located inwardly of the inner panel, and said flange portion extending transversely beyond said receiving portion for trapped engagement between the inner and outer panels adjacent the selected slot through which said receiving portion extends; and a divider wall including a corrugated cardboard divider panel extendable between said front and back walls and male connection means at respective opposite side edges of said divider panel receivable in the open-end slots of respective female connectors received in through slots of a selected pair thereof for holding the divider panel upright and in selected position.

2. A display carton as set forth in claim 1, wherein each male connection means includes a male connector attached to the respective side edges of said divider panel and adapted for interlocking receipt in the respective female connectors at the open-end slot thereof.

3. A display carton as set forth in claim 2, wherein each male connector includes a coupling portion receivable in the open-end slot of the respective female connector and an attaching portion generally coplanar with said coupling portion, said attaching portion being affixed to said divider panel.

4. A display carton as set forth in claim 3, wherein said divider wall includes a pair of adjacent corrugated divider panels, and said attaching portion of each male connector is engaged between said divider panels at a respective edge of said divider wall.

5. A display carton as set forth in claim 1, wherein each male connection means includes a respective integral marginal edge portion of said divider panel directly receivable in the open-end slot of the respective female connector.

6. A display carton as set forth in claim 5, wherein said open-end slot in each female connector is open at both ends.

7. A display carton as set forth in claim 1, wherein said through slots are vertically elongate and arranged in a horizontal row in the respective inner panel.

8. A display carton as set forth in claim 1, wherein said front wall has a height less than that of said back wall, and said divider panel has a top edge inclined downwardly from a height equal that of the back wall to a height equal that of said front wall.

9. A display carton as set forth in claim 8, further comprising a narrow beam extending parallel to the top edge of said front wall between upper front corners of said side walls, said beam being spaced above said front wall to define therebetween a viewing window.

10. A display system comprising plural elongate articles of merchandise and an open-top display carton with an adjustable divider for display of said articles in upright disposition, said display carton including:

a corrugated cardboard box including a bottom wall, a pair of side walls and front and back walls, at least said front and back walls including adjacent outer and inner corrugated cardboard panels, and said inner panels of said front and back walls each including therein spaced-apart through slots strategically located along the width of the box and paired with respective through slots in the other inner panel across the depth of the box;

at least one female connector selectively and removably receivable in any one of said slots in the inner panel of said front wall and at least one other female connector selectively and removably receivable in any one of said slots in the inner panel of said back wall, each female connector including a thin planar flange portion and a receiving portion extending substantially perpendicularly from said flange portion a distance greater than the thickness of the respective inner panel of said front and back walls, and receiving portion defining therein an open-end slot and being transversely dimensioned for passage through and locating engagement in any one of the through slots in the respective inner panel with the open-end slot located inwardly of the inner panel, and said flange portion extending transversely beyond said receiving portion for trapped engagement between the inner and outer panels adjacent the selected slot through which said receiving portion extends; and a divider wall including a corrugated cardboard divider panel extendable between said front and back walls and male connection means at respective opposite side edges of said divider panel receivable in the open-end slots of respective female connectors received in through slots of a selected pair thereof for holding the divider panel upright and in selected position; and said articles individually having a height greater than that of said carton and being supported on end atop said bottom wall whereby said articles extend above said walls of said carton.

11. A display system as set forth in claim 10, wherein said bottom wall slopes front to back whereby a depthwise stack of said articles will be caused to lean against said back wall.

12. A display system as set forth in claim 10, wherein said front wall has a height less than that of said back wall, and said divider panel has a top edge inclined downwardly from a height equal that of the back wall to a height equal that of said front wall.

13. A display system as set forth in claim 12, further comprising a narrow beam extending parallel to the top edge of said front wall between upper front corners of said side walls, said beam being spaced above said front wall to define therebetween a viewing window.

14. A open-top display carton with adjustable divider for display of merchandise in upright disposition, comprising:

a corrugated cardboard box including a bottom wall, a pair of side walls and front and back walls, at least said front and back walls including adjacent outer and inner corrugated cardboard panels, said inner panels of said front and back walls each including therein spaced-apart through slots strategically located along the width of the box and paired with respective through slots in the other inner panel across the depth of the box, and said box having a height of at least 15 inches and a length of at least 3 feet;

at least one female connector selectively and removably receivable in any one of said slots in the inner panel of said front wall and at least one other female connector selectively and removably receivable in any one of said slots in the inner panel of said back wall, each female connector including a thin planar flange portion and a receiving portion extending substantially perpendicularly from said flange portion a distance greater than the thickness of the respective inner panel of said front and back walls, said receiving portion defining therein an open-end slot and being transversely dimensioned for passage through and locating engagement in any one of the through slots in the respective inner panel with the open-end slot located inwardly of the inner panel, and said flange portion extending transversely beyond said receiving portion for trapped engagement between the inner and outer panels adjacent the selected slot through which said receiving portion extends; and a divider wall including a corrugated cardboard divider panel extendable between said front and back walls and male connection means at respective opposite side edges of said divider panel receivable in the open-end slots of respective female connectors received in through slots of a selected pair thereof for holding the divider panel upright and in selected position.

* * * * *

UNITED STATES PATENT AND TRADEMARK OFFICE

CERTIFICATE OF CORRECTION

PATENT NO. : 4,828,133

DATED : May 9, 1989

INVENTOR(S) : John Hougendobler

It is certified that error appears in the above-identified patent and that said Letters Patent is hereby corrected as shown below:

Column 8, line 40, please replace "and" with --said--.

Signed and Sealed this

Third Day of October, 1989

*Attest:*

*Attesting Officer*

DONALD J. QUIGG

*Commissioner of Patents and Trademarks*